US005901377A

United States Patent [19]

Haney

[11] Patent Number: 5,901,377

[45] Date of Patent: May 11, 1999

[54] NECKTIE PERSONALIZATION KIT

[75] Inventor: Joseph J. Haney, St. Clair Shores, Mich.

[73] Assignee: HGE Enterprises, LLC, Warren, Mich.

[21] Appl. No.: 09/021,240

[22] Filed: Feb. 10, 1998

[51] Int. Cl.[6] ..... A41D 25/00; B65D 69/00

[52] U.S. Cl. ..... 2/144; 206/575

[58] Field of Search ..... 2/144, 243.1, 244, 2/246; 101/114; 206/223, 575, 278, 281; 427/288, 421; 446/146

[56] References Cited

U.S. PATENT DOCUMENTS

| | | |
|---|---|---|
| 2,692,387 | 10/1954 | Spaniol . |
| 3,834,065 | 9/1974 | Glass et al. . |
| 4,062,286 | 12/1977 | Ford . |
| 4,224,358 | 9/1980 | Hare . |
| 4,627,110 | 12/1986 | Tengs . |
| 4,627,113 | 12/1986 | Lord . |
| 4,852,483 | 8/1989 | Bussard . |
| 4,951,483 | 8/1990 | Van Olphen . |
| 5,016,285 | 5/1991 | Just . |
| 5,073,987 | 12/1991 | Crosier . |
| 5,165,337 | 11/1992 | Schlundt . |
| 5,279,859 | 1/1994 | May . |
| 5,372,506 | 12/1994 | Hambright . |
| 5,447,770 | 9/1995 | Smith . |
| 5,514,415 | 5/1996 | Gupta . |
| 5,552,189 | 9/1996 | Shaffer . |
| 5,640,859 | 6/1997 | Fromm . |
| 5,673,434 | 10/1997 | Risk . |
| 5,699,557 | 12/1997 | Johnson . |

*Primary Examiner*—John J. Calvert
*Assistant Examiner*—Shirra L. Jenkins
*Attorney, Agent, or Firm*—Fildes & Outland P.C.

[57] ABSTRACT

A necktie personalization kit includes a fabric necktie, a two-sided disposable necktie-shaped blank to test designs, a plurality of paint containers, each containing a quantity of individually colored fabric paint for painting the disposable necktie blank and subsequently the fabric necktie and packaging for containing the fabric necktie, disposable necktie-shaped blank and plurality of paint containers therein.

7 Claims, 1 Drawing Sheet

NECKTIE PERSONALIZATION KIT

FIELD OF THE INVENTION

This invention relates generally to neckties and more particularly to a kit for personalizing a necktie to be given as a gift.

BACKGROUND OF THE INVENTION

Neckties are often presented to men as gifts for birthdays, father's day and on certain holidays. Usually the tie is just one of many similar ties having a machine applied printed pattern or design. The receiver will often see "his" tie being worn by other men who have either purchased or received the same tie.

It is desirable to provide an original, one of a kind necktie personalized by the giver so that the receiver can be reminded of the giver(s) when wearing the necktie.

SUMMARY OF THE INVENTION

The present invention provides a necktie personalization kit that allows a giver, usually a loved one, such as a child, to personalize a necktie and give it as a gift.

More specifically the necktie personalization kit includes a fabric necktie to be personalized by the giver. A two-sided disposable necktie-shaped blank is provided as a practice piece to test designs on the blank before permanently marking the fabric necktie. A plurality of paint containers, each containing a quantity of individually colored fabric paint is provided for painting the disposable necktie-shaped blank and subsequently the fabric necktie. Packaging is provided for containing the fabric necktie, disposable necktie-shaped blank and plurality of paint containers therein.

Each of the paint containers may include closures having a writing tip for marking the necktie-shaped blank and fabric necktie. Alternatively the kit can be provided with brushes and/or daubers, such as stamping implements, for applying the paint to the necktie-shaped blank and fabric necktie.

Preferably the fabric necktie includes a signature tag made of a cotton twill fabric that can be signed by the individual(s) personalizer that designs and/or decorates the fabric necktie.

These and other features and advantages of the invention will be more fully understood from the following detailed description of the invention taken together with the accompanying drawings.

DETAILED DESCRIPTION OF THE INVENTION

Figure 1:
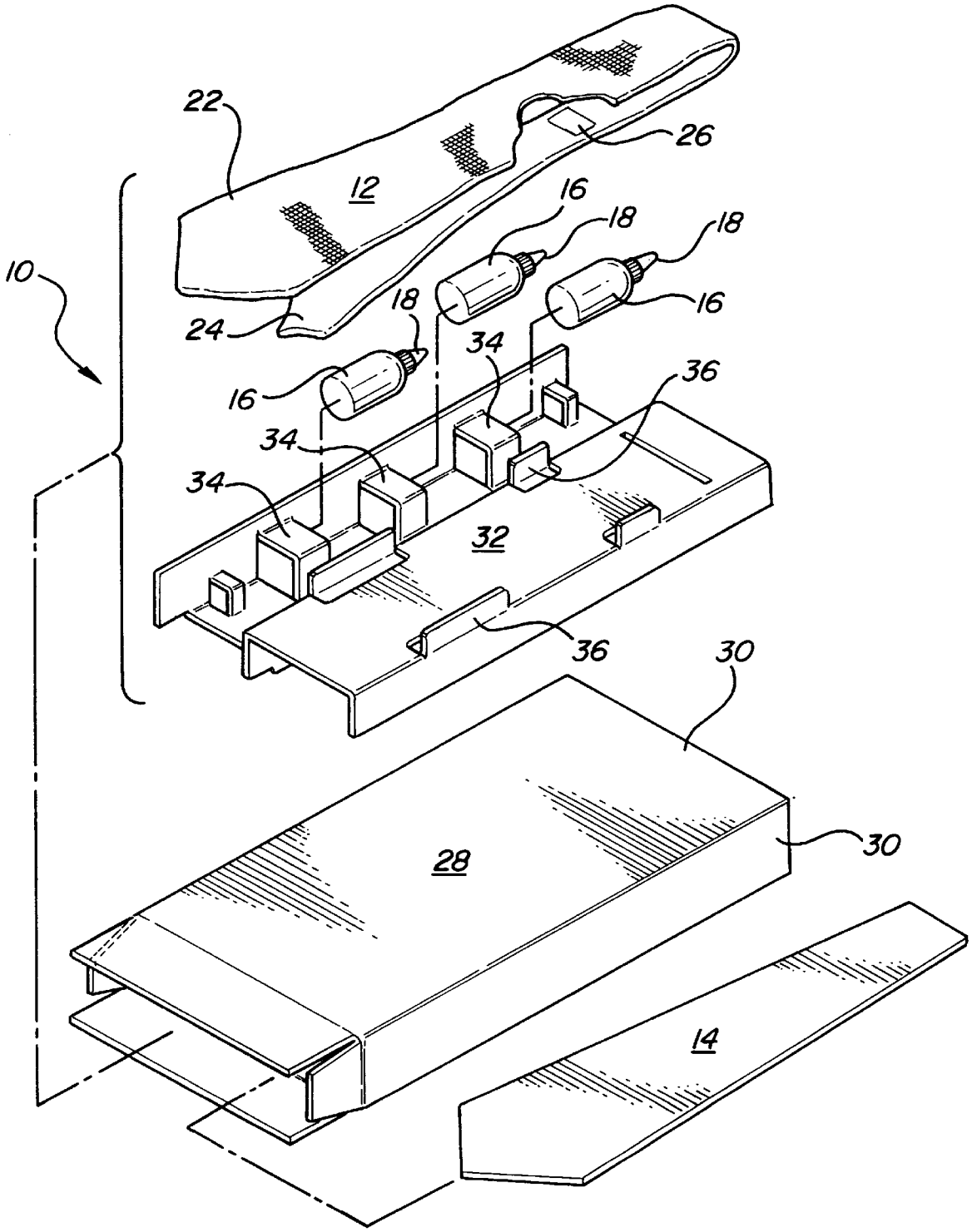
FIG. 1 is an exploded perspective view of a necktie personalization kit illustrating packaging containing a fabric necktie, a necktie-shaped blank and plurality of paint containers in accordance with the present invention.

Referring now to the drawings in detail, numeral 10 generally indicates a necktie personalization kit. As is here and aftermore fully described, the necktie personalization kit provides means for a user of the kit to design a necktie, practice the design on a practice piece and permanently personalize a necktie.

Reference to the drawing, the necktie personalization kit 10 includes a fabric necktie 12 to be personalized and typically given as a gift. Preferably the fabric necktie 12 is of a solid color of a light shade that lends itself to easy marking. A two-sided disposable necktie-shaped blank 14 is provided to allow practice designs to be tested on the blank before permanently marking the fabric necktie 12 with a chosen design. A plurality of paint containers 16, is provided for painting the disposable necktie-shaped blank 14 and fabric necktie 12. Preferably each of the containers 16 includes a quantity of individually colored fabric paint.

In the illustrated embodiment, each of the plurality of paint containers 16 includes a closure having a writing tip 18 for marking on the necktie-shaped blank 14 and fabric necktie 12.

Packaging preferably of cardboard material is provided for containing the fabric necktie 12, disposable necktie-shaped blank 14 and plurality of paint containers 16.

In the illustrated embodiment, the necktie-shaped blank 14 is of cardboard material and can be marked on both sides. The fabric necktie 12 has front and back sides 22, 24 respectively. The back side 24 includes a fabric signature tag 26 of a cotton twill material which allows the "personalizer" to sign the fabric tag after the fabric necktie is permanently marked.

The packaging includes an enclosure portion 28 with an intermediate display mounting portion 32 nested herein the enclosure portion. Enclosure portion 28 includes six sides 30 and one of the sides is openable to allow the intermediate portion 32 to be taken out of the enclosure portion. The intermediate portion 32 includes holders 34 for holding the containers 16 therein and tabs 36 for securing the necktie-shaped blank 14 and fabric necktie 12 in the bottom side 30 of the packaging.

In use, a personalizer opens one side 30 of the enclosure portion 28 to access the contents. The personalizer applies the fabric paints found in the plurality of paint containers 16 to the necktie-shaped blank 14 testing a pattern or design to be subsequently applied to the fabric necktie. Upon being satisfied with a chosen design and/or pattern, the personalizer then applies the individually colored fabric paints to the fabric necktie 12 and the design/pattern is permanently marked on the fabric necktie. The personalizer can sign the tag 26 found on the back side 24 of the necktie 12 and subsequently present the necktie to a loved one as a gift that will remind the receiver of the giver when the necktie is worn.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A necktie personalization kit comprising:

a fabric necktie to be personalized;

a two sided disposable necktie-shaped blank;

a plurality of paint containers, each containing a quantity of individually colored fabric paint for painting said disposable necktie-shaped blank and fabric necktie; and packaging for containing said fabric necktie, disposable necktie-shaped blank and plurality of paint containers.

2. The kit of claim 1 wherein said paint containers each include closures having a writing tip.

3. The kit of claim 1 wherein said necktie has front and back sides, said back side including a fabric signature tag.

4. The kit of claim 3 wherein said fabric tag is of cotton twill material.

5. The kit of claim 1 wherein said necktie blank comprises cardboard.

6. The kit of claim 1 wherein said packaging is made of cardboard.

7. The kit of claim 1 wherein said packaging includes an enclosure portion and intermediate display mounting portion.

* * * * *